US011247817B2

(12) United States Patent
Jin

(10) Patent No.: US 11,247,817 B2
(45) Date of Patent: Feb. 15, 2022

(54) GLUE BOTTLE

(71) Applicant: MURA KEN CO., LTD., Taipei (TW)

(72) Inventor: Dongmin Jin, Shangzhi (CN)

(73) Assignee: MURA KEN CO., LTD., Taipei (TW)

( * ) Notice: Subject to any disclaimer, the term of this patent is extended or adjusted under 35 U.S.C. 154(b) by 0 days.

(21) Appl. No.: 16/993,111

(22) Filed: Aug. 13, 2020

(65) Prior Publication Data

US 2021/0047085 A1 Feb. 18, 2021

(30) Foreign Application Priority Data

Aug. 14, 2019 (CN) ..... 201910749090.7

(51) Int. Cl.
*B65D 47/20* (2006.01)
*A45D 40/00* (2006.01)
*B65D 23/08* (2006.01)

(52) U.S. Cl.
CPC ..... *B65D 47/2018* (2013.01); *A45D 40/00* (2013.01); *B65D 23/0885* (2013.01)

(58) Field of Classification Search
CPC ..... A45D 40/00; B65D 1/32; B65D 23/0885; B65D 83/386; B65D 35/28; B65D 35/40; B65D 35/56; B65D 47/2018; G01F 11/082; G01F 11/286; G01F 11/288; G01F 11/08; A47G 19/183; A47K 5/122; A61B 17/00491
USPC ..... 222/214
See application file for complete search history.

(56) References Cited

U.S. PATENT DOCUMENTS 3,395,836 A * 8/1968 Bernhardt ..... A47K 5/122 222/215
3,549,055 A * 12/1970 Gatland ..... A61M 15/009 222/182
4,177,939 A * 12/1979 Thomas ..... B65D 1/0292 222/153.13
5,673,822 A * 10/1997 Chaimin ..... A61F 9/0008 222/183
5,899,365 A * 5/1999 Eichler ..... A61M 15/0001 222/162

(Continued)

FOREIGN PATENT DOCUMENTS

TW M384110 U1 7/2010
TW M451256 U1 4/2013

OTHER PUBLICATIONS

TW Office Action in Application No. 109127326 dated Mar. 11, 2021.

*Primary Examiner* — Patrick M. Buechner
(74) *Attorney, Agent, or Firm* — Maschoff Brennan

(57) ABSTRACT

A glue bottle includes a bottle body and a head part mating with each other. A housing surrounds the bottle body, a top portion of the bottle body sticks out of the housing and mating with the head part, a bottom portion of the bottle body is disposed within the housing. The housing has a through hole and a guiding hole connected to the through hole. The bottle body has a guiding bar mating with the guiding hole. The housing is made of elastic material. The housing further has at least one protrusion located at an inner surface of the housing and in contact with the bottle body. The housing further has at least one notch. When two opposite edges of the notch are in contact with each other, the protrusion is forced to squeeze the bottle body so as to deform the bottle body.

10 Claims, 11 Drawing Sheets

(56) References Cited

U.S. PATENT DOCUMENTS

| | | | | |
|---|---|---|---|---|
| 7,175,053 | B2 * | 2/2007 | Simon | B05B 11/3056 222/162 |
| 7,353,971 | B2 * | 4/2008 | Stradella | B05B 11/02 222/162 |
| 7,798,368 | B2 * | 9/2010 | Anderson | B05B 11/3056 222/162 |
| 8,752,543 | B2 * | 6/2014 | Davies | A61M 15/009 128/200.14 |
| 9,211,994 | B2 * | 12/2015 | Andersen | B65D 83/226 |
| 2005/0258191 | A1 * | 11/2005 | Davies | B05B 11/3057 222/162 |

* cited by examiner

GLUE BOTTLE

CROSS-REFERENCE TO RELATED APPLICATIONS

This non-provisional application claims priority under 35 U.S.C. § 119(a) on Patent Application No(s). 201910749090.7 filed in China on Aug. 14, 2019, the entire contents of which are hereby incorporated by reference.

TECHNICAL FIELD

The disclosure relates to a glue bottle for eyelash grafting in the cosmetic field, more particularly to a glue bottle able of delivering drops of a fixed volume.

BACKGROUND

Nowadays, people pay more attention on their appearances of themselves, therefore some use cosmetic techniques to improve the defects of their appearances. False eyelashes grafting or false nails grafting are well-known cosmetic techniques in this field. Regarding to the false eyelashes grafting, the eyelashes are adhered on the nature eyelashes at one or multiple times via glue, and the density, lengths or curvatures of the false eyelashes can be determined according to the nature eyelashes of themselves. During the false eyelashes grafting, glue is dropped on the false and nature eyelashes, and the glue will react with air so as to be solidified, resulting in the false and nature eyelashes are connected to each other. Generally, it requires a certain amount of time to graft the false eyelashes to the nature eyelashes, therefore the amount of the glue dropping on the false and nature eyelashes is the key to maintain the quality of the false eyelashes grafting. In specific, when the amount of the glue dropping on the false and nature eyelashes is too less, the glue dropping on the false and nature eyelashes may rapidly dry out, thereby decreasing the quality of the false eyelashes grafting. On the contrary, when the amount of the glue dropping on the false and nature eyelashes is too much, it may result in the waste of the glue and increasing the time of the false eyelashes grafting.

After the glue bottle was used, the airtightness of the glue bottle is required to be ensured, otherwise a portion glue at the outlet of the glue bottle may dry out so as to block the outlet of the glue bottle, causing the glue bottle may be unable to use anymore. In addition, if the airtightness of the glue is not enough, air may enter into the glue bottle so as to cause the glue to deteriorate, thereby affecting the quality of glue and thus reducing the quality of the false eyelashes grafting.

On the other hand, the amount of glue squeezed out from the glue bottle depends on how a user squeezes the glue bottle and how much force the user applies on the glue bottle, therefore even an experienced user, it is difficult to maintain a constant amount of the glue squeezed out from the glue bottle in each squeeze of the glue bottle. As a result, the glue squeezed out from the glue bottle may be not enough so as to rapidly dry out, thereby decreasing the quality of the false eyelashes grafting. Or, the glue squeezed out from the glue bottle may be too much, result in the waste of the glue and increasing the time of the false eyelashes grafting.

SUMMARY OF THE INVENTION

The disclosure provides a glue bottle capable of squeezing out a fixed volume of glue every time so as to achieve economical usage of the glue to reduce the cost and to ensure the quality of applying false eyelashes. In addition, the glue bottle has a head part to ensure the airtightness even if repeatedly used a great number of times, thereby preventing deterioration and thus facilitating the preservation of the glue over time and saving the cost and increasing the safety of using it.

In order to solve the aforementioned problems. One embodiment of the disclosure provides a glue bottle. The glue bottle includes a bottle body and a head part mating with each other. A housing surrounds the bottle body, a top portion of the bottle body sticks out of the housing and mating with the head part, a bottom portion of the bottle body is disposed within the housing. The housing has a through hole located at a top end of the housing, a diameter of the through hole is smaller than a maximum diameter of the bottle body. The housing further has a guiding hole located at the top end of the housing and connected to the through hole. The bottle body has a guiding bar located at the top portion of the bottle body, and the guiding bar mates with the guiding hole. The housing is made of elastic material. The housing further has at least one protrusion located at an inner surface of the housing and in contact with the bottle body. The housing further has at least one notch. When two opposite edges of the at least one notch are in contact with each other, the at least one protrusion is forced to squeeze the bottle body so as to deform the bottle body.

Preferably, a central line of the at least one notch is perpendicular to a central line of the at least one protrusion, the at least one protrusion is located at a middle portion of the housing, the at least one notch extend vertically, and the at least one notch and the at least one protrusion have the same quantity.

Preferably, the quantity of the at least one protrusion is two, the two protrusions are opposite to each other with respect to a central line of the housing, each of the two protrusions is a U-shaped structure having an opening facing downward, and an upper end and a lower end of each of the two protrusions have rounded corners.

Preferably, the at least one notch is a U-shaped tapered notch having an opening facing upward or downward, a length of the at least one notch is at least five-sixths to a length of the housing, and the at least one notch has two opposite surfaces that are at an angle ranging from 1.5 degrees to 2.5 degrees.

Preferably, a cap is disposed on the top end of the housing, the cap has a plurality of reinforcement ribs arranged at an inner surface of the cap, the cap further has a step located at an end of the cap close to the housing, a sealing ring is disposed between the step and the housing, a portion of the sealing ring protruding the step is in contact with a bottom surface of the head part.

Preferably, the head part comprises a cover body, a nozzle, a sealing pad, and a fixing seat. The nozzle, the sealing pad, and the fixing seat are located in the cover body, the fixing seat is fixed at a top portion of the cover body. The sealing pad is fixed in the fixing seat, the nozzle is disposed on the bottle body. When the cover body and the bottle body are screwed with each other, a top portion of the nozzle presses against the sealing pad, a bottom portion of the nozzle is located below a contact surface of a middle portion of the cover body. The nozzle has an outlet channel connected to an accommodation space of the bottle body. The nozzle includes an extension portion at the top portion of nozzle and a mount portion at the bottom portion of the nozzle. An outer annular surface of the mount portion is in contact with an inner annular surface of the bottle body. The mount portion has a flange protruding outward, and the flange is located between and in contact with the contact surface of the cover body and an upper end surface of the bottle body.

Preferably, an annular reinforcement portion extends downward from the flange. A gap between an inner annular surface of the annular reinforcement portion and the outer annular surface of the mount portion is larger than a thickness of the top portion of the bottle body. An outer diameter of the annular reinforcement portion is smaller than an inner diameter of a portion of the cover body located below the contact surface. The annular reinforcement portion has a uniform thickness, and a lower portion of the annular reinforcement portion is inclined outward.

Preferably, the fixing seat is T shape, the fixing seat comprises a head part, an indentation, and a positioning protrusion, the cover body has a positioning recess inside, the head part is fixed in the positioning recess, the sealing pad is disposed in the indentation, the positioning protrusion is disposed in a lower portion of the indentation and extends inwards, a lower surface of the sealing pad is in contact with an upper surface of the positioning protrusion, the fixing seat and the sealing pad are made of elastic material.

Preferably, a thickness of the sealing pad is substantially equal to a depth of the indentation. A diameter of the sealing pad is smaller than a minimum diameter of the indentation, there are a plurality of positioning tips at a bottom inner surface of the head part, the plurality of positioning tips press against the sealing pad.

Preferably, the fixing seat and the sealing pad are made of silicone. There is at least one hole located at an outer top surface of the head part, and the at least one hole is connected to the indentation.

Preferably, the quantity of the at least one hole is two, the two holes are opposite to each other with respect to an axis of the fixing seat, the two holes are curved shapes and located close to a periphery of the head part, the head part has two rounded corners respectively located at the outer top surface and a lower surface of the head part.

Preferably, the extension portion is in a cone shape tapering from the bottom to the top of the extension portion. The extension portion has a first channel, the first channel is in a cone shape tapering from the bottom to the top of the extension portion. An axis of the first channel and an axis of the extension portion are coaxial.

Preferably, the mount portion has a second channel. The second channel is in a cylindrical shape, an axis of the second channel and an axis of the mount portion are coaxial. The first channel and the second channel are coaxially connected to each other and together form the outlet channel.

Preferably, a base portion is coaxially disposed on the mount portion and located below the mount portion. The base portion has a groove located at an outer surface of the base portion and an end of the base portion close to the mount portion. A first sealing ring is disposed in the groove, and the first sealing ring is located between and clamped by the bottle body and the base portion.

The cover body has a recess located at a top end of the cover body. The cover body further has a jagged structure and a plurality of reinforcement ribs. The jagged structure is located at a lower portion of an outer surface of the cover body, the plurality of reinforcement ribs are located at an upper portion of the outer surface of the cover body, and a top end of each of the plurality of reinforcement ribs has a chamfer.

Compared with the prior art, the present disclosure has the advantages and positive effects as follows.

In the disclosure, the housing surrounds the bottle, and the housing has the protrusion and the notch, such that the notch can limit the deformation amount of the housing when the protrusion is forced to deform the housing, thereby achieving the consistency of the deformation of the housing. Therefore, the deformation of the bottle body caused by the protrusions can also be fixed, such that the glue bottle is able to squeeze out a fixed volume of glue every time so as to achieve economical usage of the glue to reduce the cost and to ensure the quality of false eyelashes grafting.

Since the sealing pad is disposed in the cover body, and the nozzle press against the sealing pad after the cover body and the bottle body are tightly screwed with each other, such that the sealing pad can seal the outlet channel and prevent air from entering into the bottle from the outlet channel. The mount portion of the nozzle is in contact with the inner surface of the bottle body, such that the mount portion can prevent air from entering into the bottle body from the place between the mount portion and the bottle body. The flange of the mount portion can prevent air from entering into the bottle body from threads of the cover body and the bottle body, thereby further facilitating the airtightness of the bottle body. Since the glue bottle has a great airtightness, the glue in the glue bottle is prevented from being oxidized, such that it ensures the stable quality of the glue after the cover is opened repeatedly, thereby reducing the cost and increasing the safety in using glue.

The fixing seat and the sealing pad are simple in structure, and the sealing pad is firmly fixed in position. Therefore, the fixing seat and the sealing pad can be easily installed in the limited space of the cover body, thereby achieving a simple and compact arrangement.

The annular reinforcement portion has the uniform thickness, and the lower portion of the annular reinforcement portion is inclined outward, such that the annular reinforcement portion can increase the structure strength and assist the installation of the nozzle.

The first sealing ring can prevent gas from entering into the bottle body from the place between the mount portion and the bottle body, thereby further facilitating the airtightness, and prevent the glue from leaking and entering into the place between the mount portion and the bottle body, thereby avoiding wasting the glue.

BRIEF DESCRIPTION OF THE DRAWINGS

The present disclosure will become better understood from the detailed description given herein below and the accompanying drawings which are given by way of illustration only and thus are not intending to limit the present disclosure and wherein.

DETAILED DESCRIPTION

Figure 1:
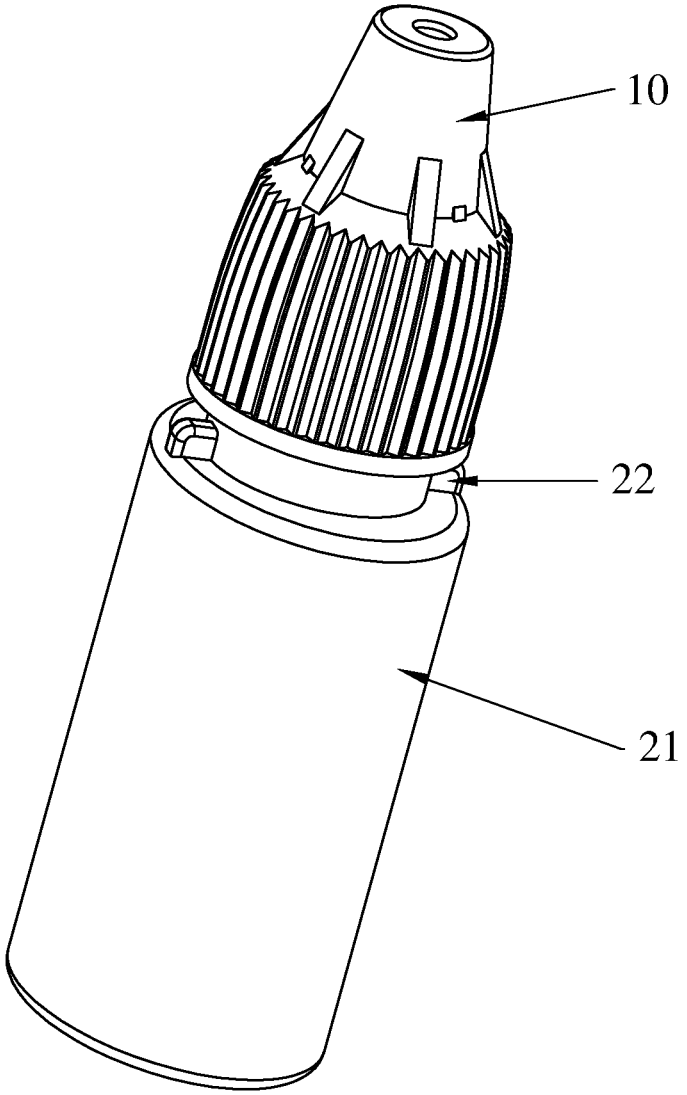
FIG. 1 is a perspective view of a glue bottle according to one embodiment of the disclosure when a housing and a cap are removed.
Figure 2:
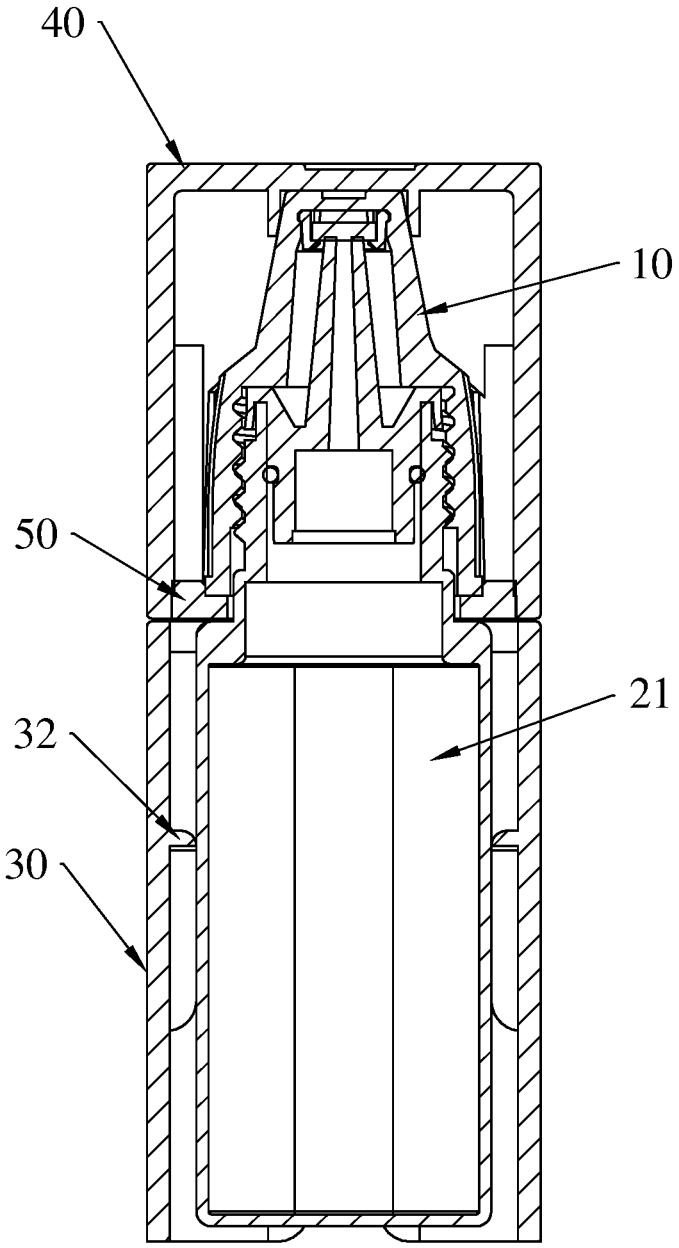
FIG. 2 is a cross-sectional view of a glue bottle according to one embodiment of the disclosure.

Note that the embodiments and features in the embodiments of the disclosure can be mutually combined without any conflict therebetween.

In the description given below, the terms "central", "vertical", "transverse", "upper", "lower", "front", "back", "left", "right", "upright", "horizontal", "top", "bottom", "inside", "outside" are used to indicate orientations or positions of components in the figures for the purpose of illustration, and they do not limit or imply the components has to be constructed or operated in such orientations or positions, therefore those terms cannot limit the disclosure. In addition, the terms "first", "second" and so on are only used to demonstrate purposes, and cannot be understood as indicating or implying relative importance or implicitly indicating the number of indicated technical features. Thus, the features defined with "first", "second" and so on may explicitly or implicitly include one or more of these features. In the description of the disclosure, "plurality" means two or more unless otherwise specified.

In the description of disclosure, it should be noted that the terms "installation", "connected" and "coupled" should be interpreted broadly unless otherwise clearly specified and limited. For example, those terms each can be interpreted as a fixed connection, a detachable connection, an integrally connection, a mechanical connection, an electrical connection, a direct connection, an indirect connection through an intermediate medium, or an internal communication between two components. For those having an ordinary skill in the art, the specific meanings of the aforementioned terms in the disclosure can be understood through specific situations.

The following paragraphs will describe the specific embodiments of the disclosure in conjunction with the figures.

As shown in FIGS. 1 to 8, the disclosure provides a glue bottle capable of squeezing out a fixed volume of glue every time. The glue bottle includes a bottle body 21 and a head part 10 mating with each other. A housing 30 surrounds the bottle body 21. A top portion of the bottle body 21 sticks out of the housing 30 for mating the head part 10. A bottom portion of the bottle body 21 is disposed within the housing 30. The housing 30 has a through hole 34 located at a top end of the housing 30. A diameter of the through hole 34 is smaller than the maximum diameter of the bottle body 21 so as to position the upper limit of the bottle body 21 while mating the bottle body 21 and the housing 30. The housing 30 further has two guiding holes 32 located at the top end of the housing 30 and connected to the through hole 34. The bottle body 21 has two guiding bars 22 located at the top portion of the bottle body 21 for mating the guiding holes 32. When the bottle body 21 is placed in the housing 30 in position, the upper end of the guiding bar 22 is located lower than or flush with the top end of the housing 30 for achieving an aesthetic appearance.

The housing 30 is made of elastic material, such that the housing 30 can be deformed as force is exerted thereto. The housing 30 has at least one protrusion 33 located at an inner surface of the housing 30 and configured to be in contact with bottle body 21. The housing 30 further has at least one notch 31. When two opposite edges of the notch 31 are in contact with each other, the protrusion 33 is forced to squeeze the bottle body 21 so as to deform the bottle body 21.

Preferably, a central line of the notch 31 is perpendicular to a central line of the protrusion 33, thus, the way of pressing is consistent with the direction the protrusions 33 apply force, achieving a better pressing effect. The protrusions 33 are located at the middle portion of the housing 30, ensuring that the glue inside the bottle body 21 can be squeezed out whether it is in low or high amount, thereby ensuring the stability of the output amount. In this embodiment, the notches 31 extend vertically, and the notches 31 and the protrusions 33 have the same quantity, such that they are arranged in a symmetric and visually-pleasing manner and are able to uniformly apply force. How much the fixed volume of glue to be squeezed out every time relates to the width of the notch 31, and the width of the notch 31 can be modified according to actual requirements. In specific, the larger the width of the notch 31 the greater the deformation of one squeeze, thus, the deformation of the bottle body 21 caused by the protrusions 33 becomes greater and therefore squeeze out a greater amount of glue, on the contrary, the smaller the width of the notch 31 the less amount of glue to be squeezed out of one squeeze.

Preferably, there are two protrusions 33 respectively arranged opposite to each other with respect to a central line of the housing 30. Each of the protrusions 33 is in U shape having an opening facing downward, which can increase the contact area and facilitate squeezing, can decrease the rigidity of the housing 30 for it to be easily deformed, and also can save the material and therefore reduce the manufacturing cost, especially for the mass production, the cost for the mass production can be largely reduced due to the reduction of the manufacturing cost for one unit. In one embodiment, an upper end and a lower end of the protrusion 33 both have rounded corners 331 for easy placement of the bottle body 21 and which also can prevent the bottle body 21 from scratching the housing 30 during the placement of the bottle body 21 into the housing 30. In one embodiment, the protrusions 33 are in a symmetrical arrangement, such that the bottle body 21 can be uniformly squeezed by the protrusions 33. Therefore, the glue can be smoothly squeezed out from the bottle body 21 and therefore prevent unexpectedly ejecting the glue, which facilitates works after applying the glue.

Preferably, the notch 31 is a U-shaped notch having an opening facing upward or downward. The length of the notch 31 is at least five-sixths to the length of the housing 30, which ensures that the housing 30 can be easily deformed when being squeezed. In one embodiment, the housing 30 has a thickness ranging from 1.2 mm to 2 mm. Preferably, the thickness of the housing 30 may be 1.5 mm. The thicker the housing 30 the greater the force is required to deform the housing 30. Generally, women are the majority users of the glue bottle in false eyelash grafting, but false eyelash grafting may be a time-consuming task, so the convenience and effort-saving become important factors, the thinner the housing 30 the easier the deformation, but leads to insufficient rigidity and thus may fail to ensure the consistency of the output amount for each squeeze and may shorten the lifespan. Thus, the thickness of the housing 30 shall be in proper range. In one embodiment, the notch 31 may be in a tapered shape having two opposite surfaces that are at an angle ranging from 1.5 degrees to 2.5 degrees to each other. Preferably, the angle may be 2 degrees. The shape of the notch 31 had considered the effort-saving and operation of squeezing, and the end of the shape is more easily deformable. Note that the notch 31 is not restricted to be in the shape as shown and may be modified to be in other suitable shapes, such as an elliptical shape as long as it can ensure the consistency of the deformation amount of each squeeze. The consistency of the deformation can ensure the press amount of the protrusions 33 to the bottle body 21 so as to make the glue squeezed out from the bottle body 21 consistent in amount. Therefore, any suitable shape of the notch is still in the scope of the disclosure and can be modified according to an actual requirement.

Figure 3:
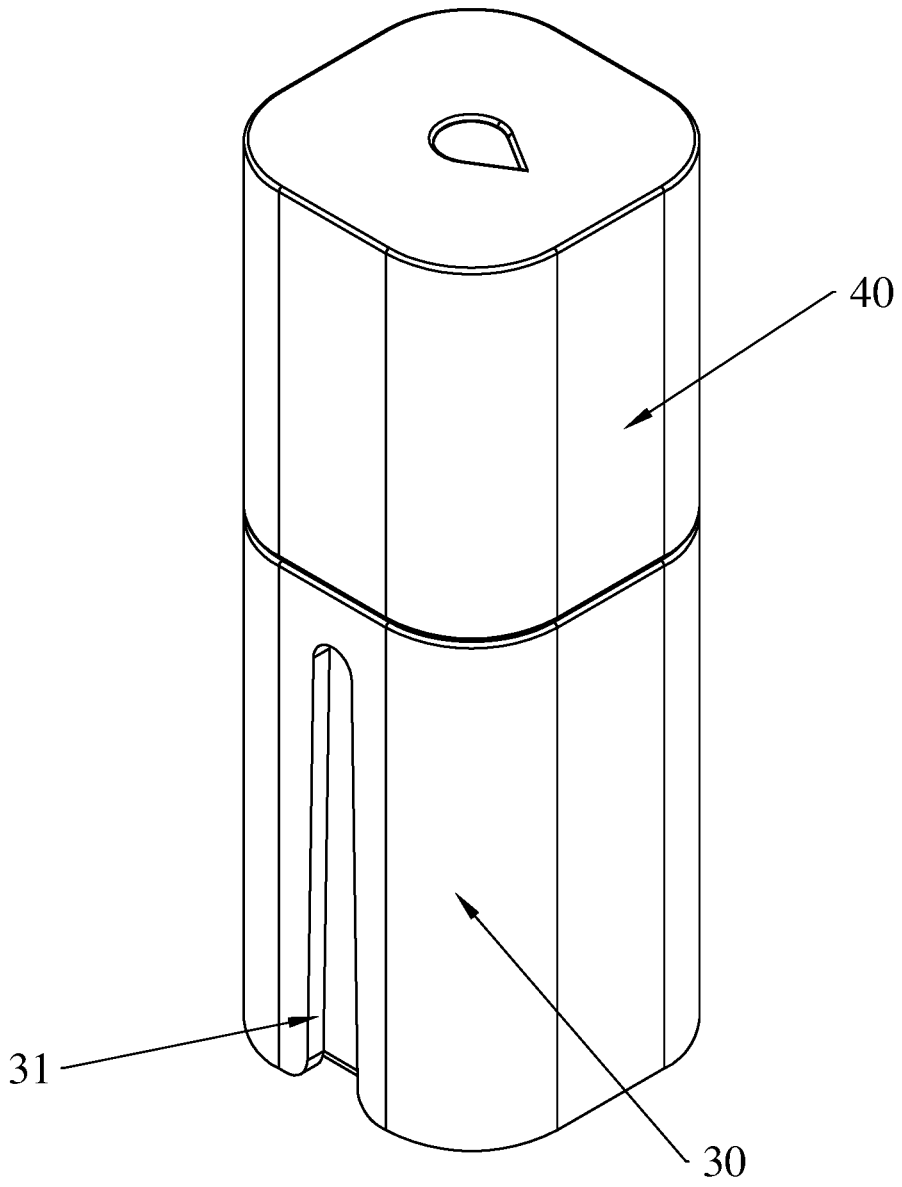
FIG. 3 is a perspective view of the glue bottle in FIG. 2.
Figure 4:
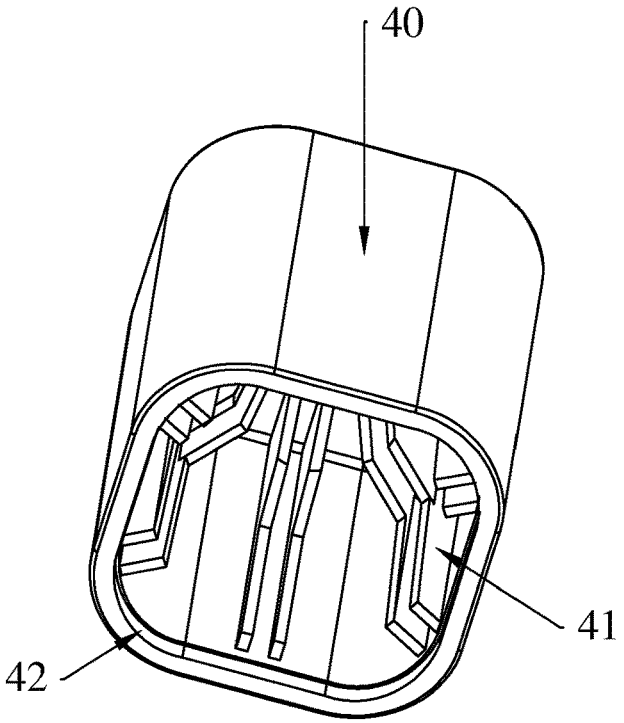
FIG. 4 is a perspective view of a cap of the glue bottle in FIG. 3.
Figure 5:
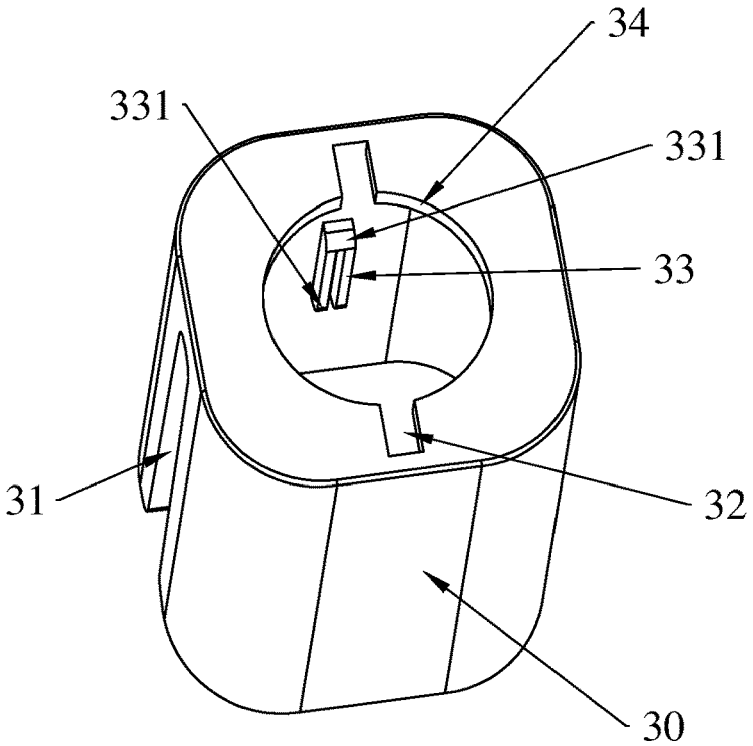
FIG. 5 is a top view of a housing of the glue bottle in FIG. 3.
Figure 6:
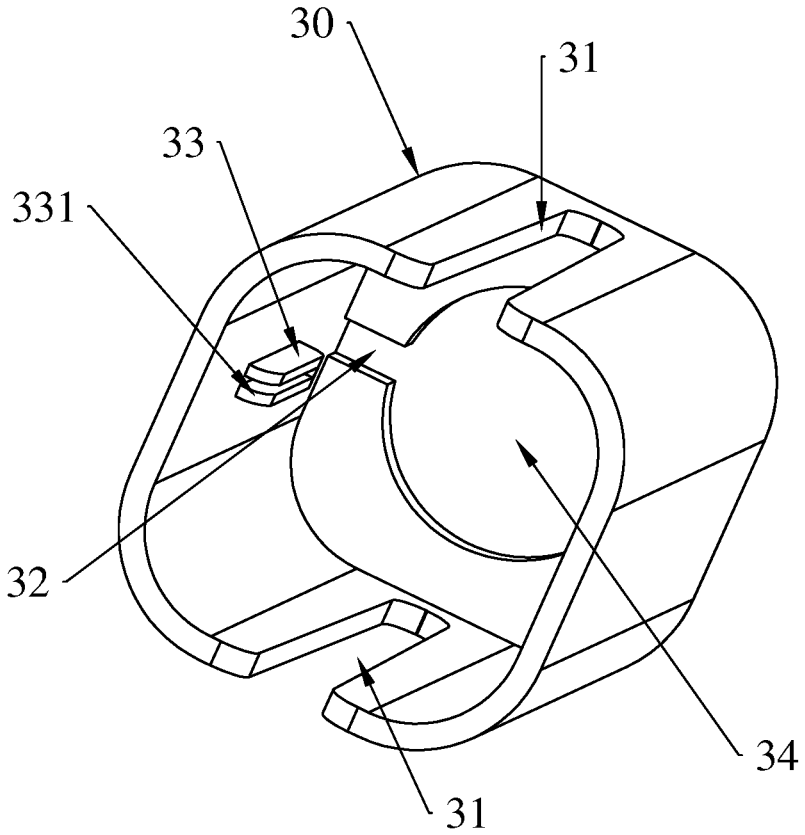
FIG. 6 is a bottom view of the housing of the glue bottle in FIG. 3.
Figure 7:
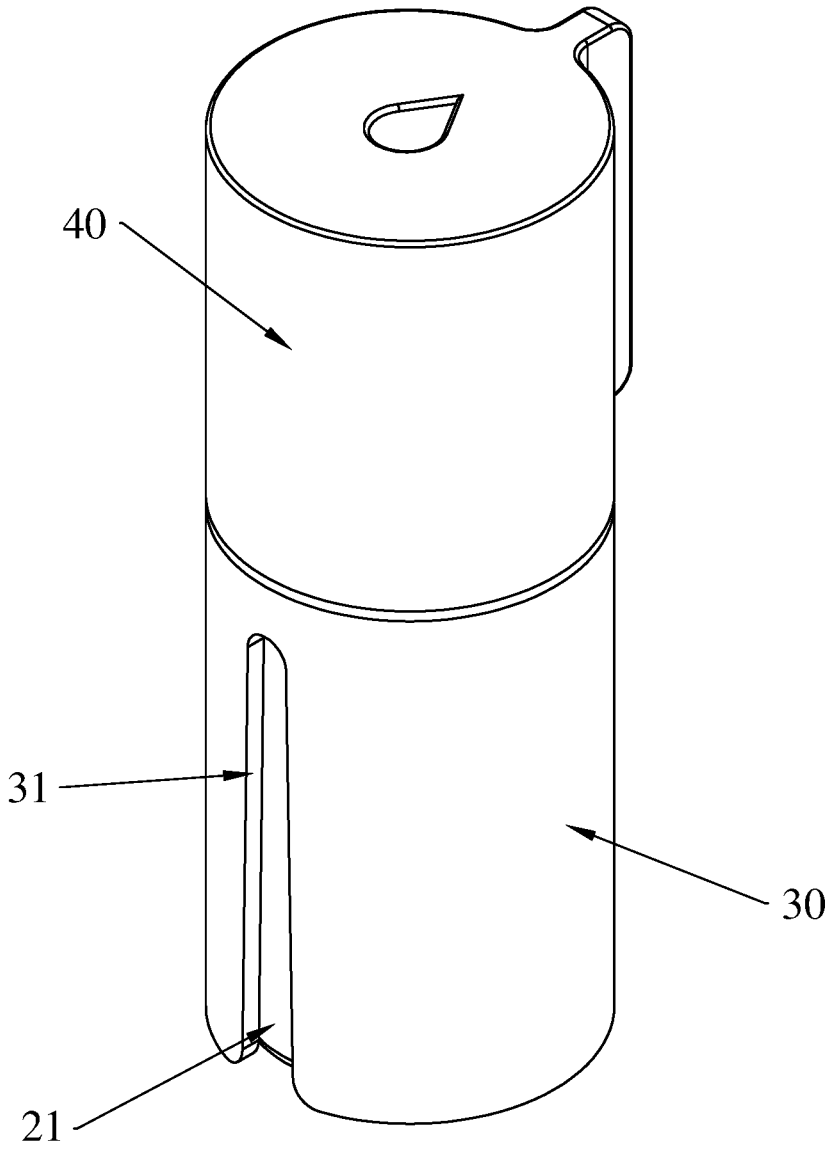
FIG. 7 is a perspective view of a glue bottle according to one embodiment of the disclosure when a housing of the glue bottle is in a circular shape.
Figure 8:
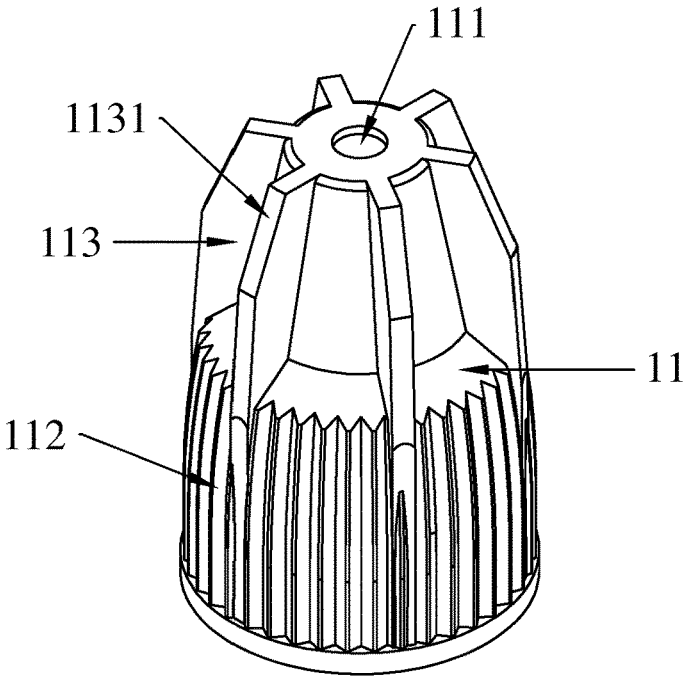
FIG. 8 is a perspective view of a head part of a glue bottle according to one embodiment of the disclosure.
Figure 9:
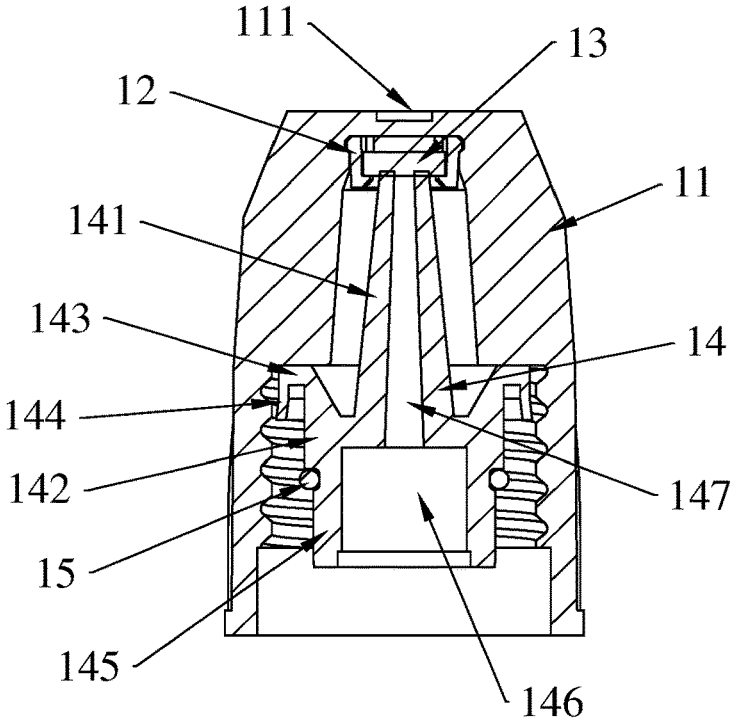
FIG. 9 is a cross-sectional view of the head part in FIG. 8.
Figure 10:
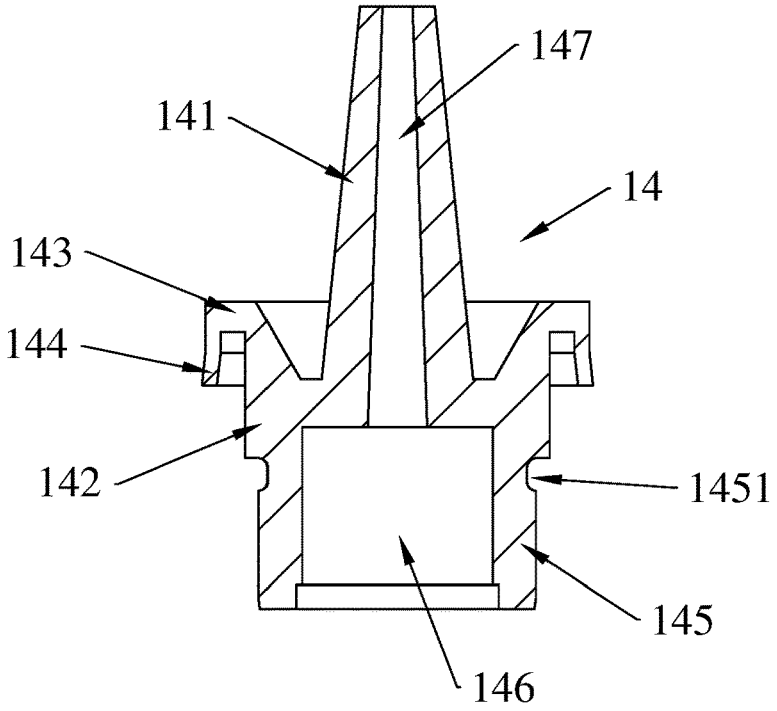
FIG. 10 is a cross-sectional view of a nozzle of the head part in FIG. 9.
Figure 11:
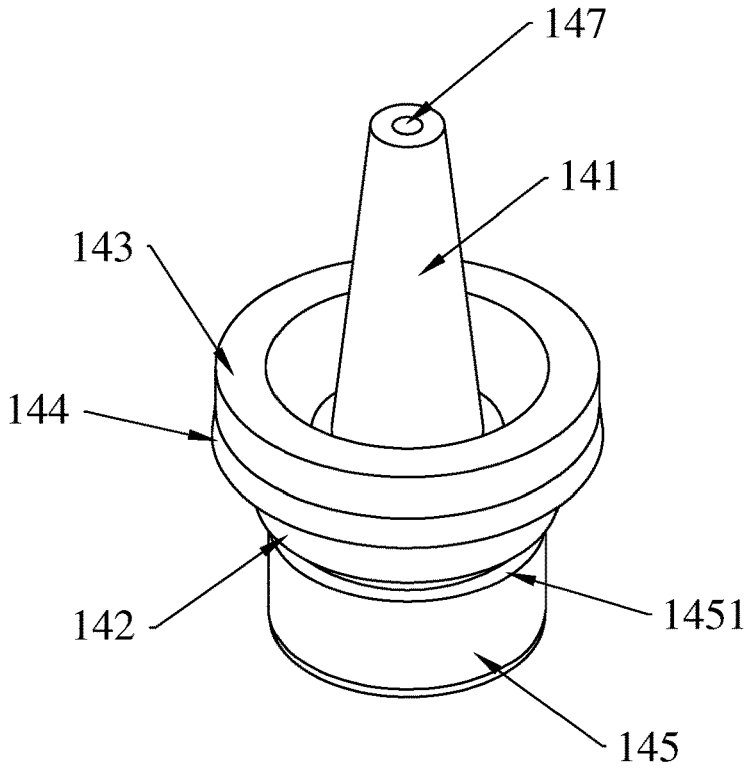
FIG. 11 is a perspective view of the nozzle of the head part in FIG. 9.
Figure 12:
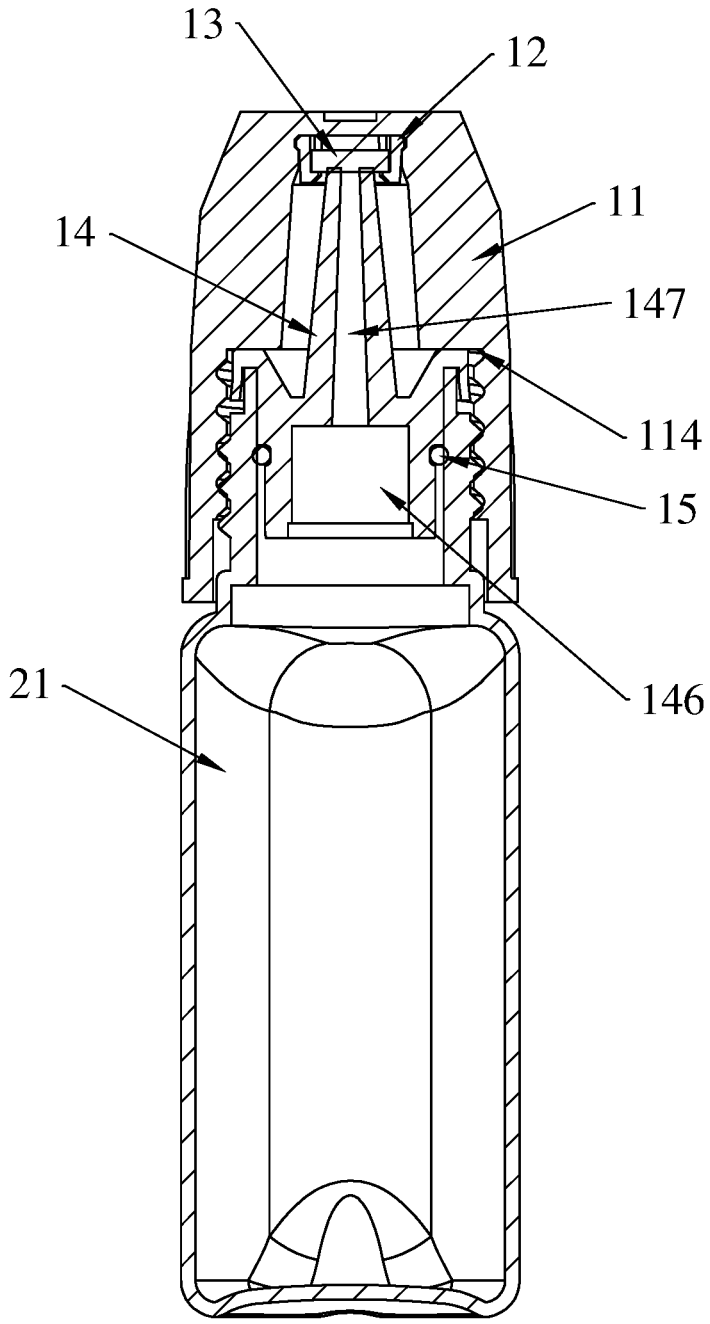
FIG. 12 is a cross-sectional view of the head part in FIG. 9 when the head part is screwed with a bottle body.
Figure 13:
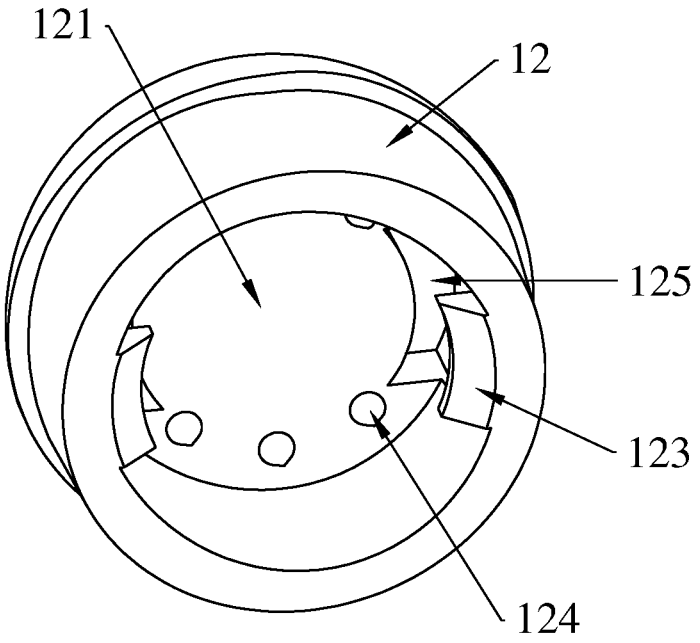
FIG. 13 is a bottom view of a fixing seat of the head part in FIG. 9.
Figure 14:
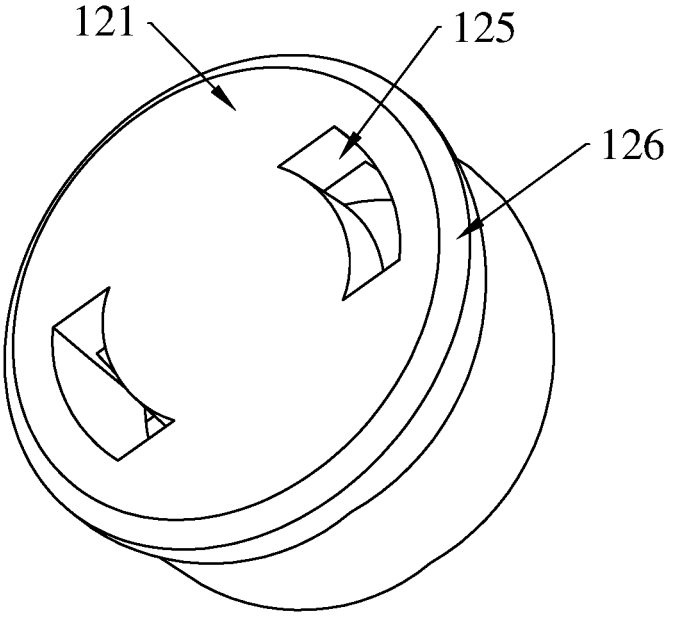
FIG. 14 is a top view of the fixing seat of the head part in FIG. 9.
Figure 15:
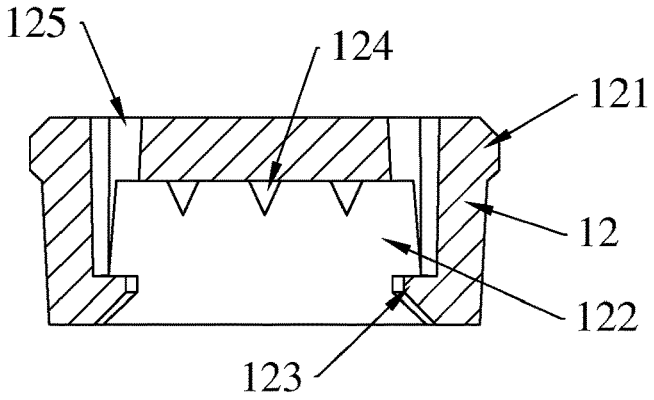
FIG. 15 is a cross-sectional view of the fixing seat of the head part in FIG. 9.
Figure 16:
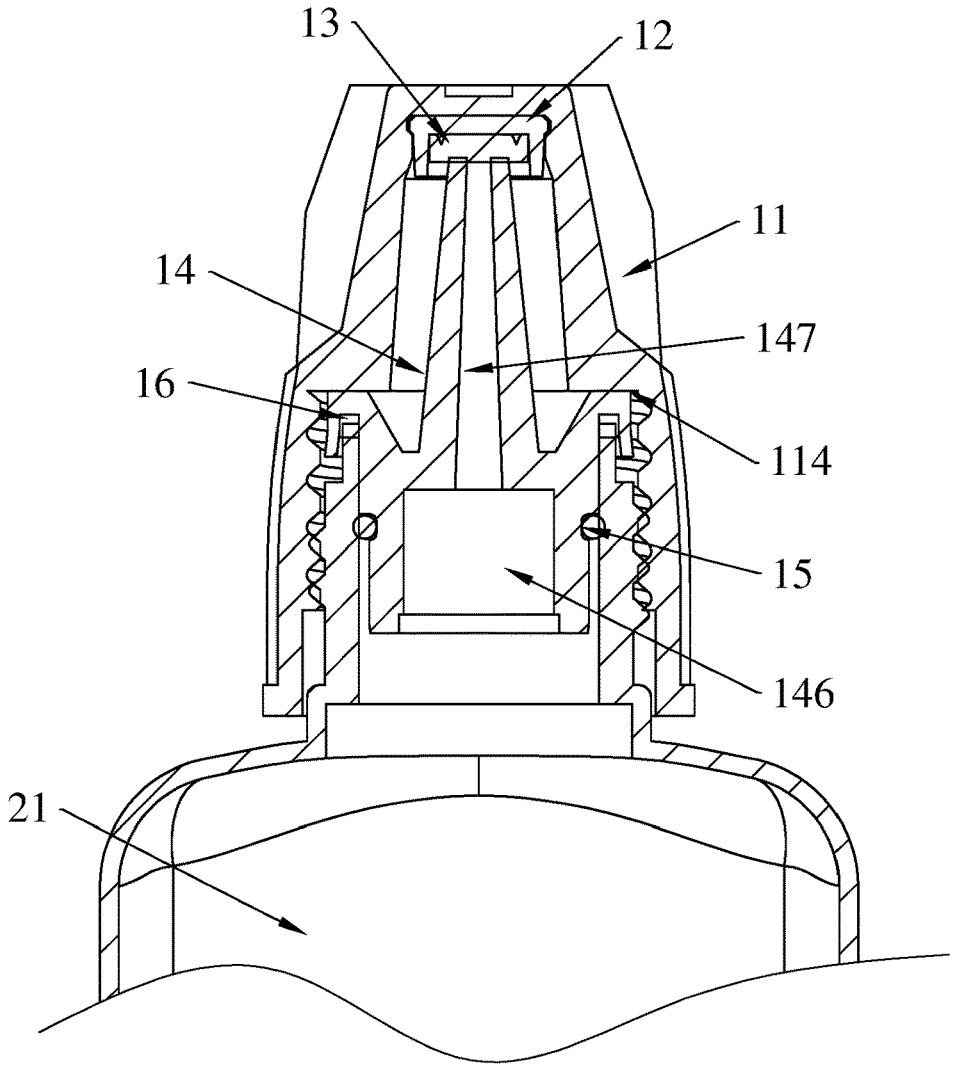
FIG. 16 is a partial enlarged cross-sectional view of the head part and the bottle body in FIG. 12.

Preferably, a cap 40 is disposed on the top end of the housing 30. The cap 40 has a plurality of reinforcement ribs 41 arranged at an inner surface of the cap 40 to increase the structural strength of the cap 40. The cap 40 further has a step 42 located at an end of the cap 40 close to the housing 30. A sealing ring 50 is disposed between the step 42 and the housing 30. A portion of the sealing ring 50 protruding from the step 42 is in contact with a bottom surface of the head part 10. The sealing ring 50 ensures the airtightness between the housing 30 and the cap 40 and provides the protection and preservation to the glue in the bottle body 21. More preferably, the cap 40 may have a decorative area at its top end for creating a feature distinguishable from other products and offering an aesthetic appearance. The cap 40 may have a shape mating with the housing 30 for achieving an aesthetic appearance. Note that the housing 30 is not restricted to be in the shape as shown and may be modified to be other suitable shapes, such as circular or rectangular as long as it can achieve the purpose of squeezing out a fixed amount of glue. In the case that the cap 40 is in a circular shape, the outer surface of the cap 40 may have protrusions for ease of carrying around and operation convenience. FIG. 3 illustrates the housing 30 in a rectangular shape, and FIG. 7 illustrates the housing in a circular shape.

As shown in FIGS. 8 to 15, the head part 10 includes a cover body 11, a nozzle 14, a sealing pad 13, and a fixing seat 12. The nozzle 14, the sealing pad 13, and the fixing seat 12 are located in the cover body 11. The fixing seat 12 is fixed at a top portion of the cover body 11. The cover body 11 has a positioning recess located inside the top portion of the cover body 11. The fixing seat 12 is fixed in the positioning recess, and the fixing seat 12 mates with the positioning recess. The fixing seat 12 is made of silicone. During the installation of the fixing seat 12, the fixing seat 12 can be deformed and placed in the positioning recess of the cover body 11. The sealing pad 13 is engaged in the fixing seat 12. The engagement between the sealing pad 13 and the fixing seat 12 is secured so that the sealing pad 13 is prevented from falling off from the fixing seat 12, and the nozzle 14 can be properly positioned by the sealing pad 13. As the cover body 11 has been tightly screwed in position, a top portion of the nozzle 14 presses against the sealing pad 13 so as to achieve an interference fit to achieve the airtightness between the nozzle 14 and the sealing pad 13. The nozzle 14 may be made of plastic or elastic metal film, such that the nozzle 14 is lightweight. The nozzle 14 is disposed on the bottle body 21. When the cover body 11 has been tightly screwed in position, a bottom portion of the nozzle 14 is located below a contact surface 114 of a middle portion of the cover body 11. The nozzle 14 has an outlet channel connected to an accommodation space of the bottle body 21. The bottom portion of the nozzle 14 is in contact with the contact surface 114 so as to ensure the airtightness between the cover 11 and the nozzle 14.

The nozzle 14 includes an extension portion 141 at the top portion of the nozzle 14 and a mount portion 142 at the bottom portion of nozzle 14. An outer annular surface of the mount portion 142 is in contact with an inner annular surface of the bottle body 21. The mount portion 142 has a flange 143 protruding outward. The flange 143 is located between and in contact with the contact surface 114 and an upper end surface of the bottle body 21. The mount portion 142 can ensure the airtightness of the bottle body 21 so as to prevent gas from entering into the bottle body 21 from the place between the mount portion 142 and the bottle body 21. The flange 143 can prevent gas from entering into the bottle body 21 from the portion where the cover body 11 is screwed with the bottle body 21, thereby securing the airtightness of the bottle body 21.

Preferably, an annular reinforcement portion 144 extends downward from the flange 143. A gap between an inner annular surface of the annular reinforcement portion 144 and the outer annular surface of the mount portion 142 is larger than a thickness of the top portion of the bottle body 21. An outer diameter of the annular reinforcement portion 144 is smaller than an inner diameter of a portion of the cover body 11 located below the contact surface 114. The annular reinforcement portion 144 has a uniform thickness, and a lower portion of the annular reinforcement portion 144 is inclined outward. The annular reinforcement portion 144 can increase the structural strength of the nozzle 14 and assist the installation of the nozzle 14. More preferably, a second sealing ring 16 may be disposed between the flange 143 and the upper end surface of the bottle body 21, thereby further increasing the airtightness between the nozzle 14 and the bottle body 21.

Preferably, the fixing seat 12 is in T shape. The fixing seat 12 includes a head part 121, an indentation 122, and a positioning protrusion 123. The cover body 11 has a positioning recess as discussed above. The head part 121 is fixed in the positioning recess. The sealing pad 13 is disposed in the indentation 122. The positioning protrusion 123 is disposed in a lower portion of the indentation 122 and extends inwards. The lower surface of the sealing pad 13 is in contact with an upper surface of the positioning protrusion 123. The fixing seat 12 and the sealing pad 13 are made of elastic material. The fixing seat 12 and the sealing pad 13 are simple in structure, and the sealing pad 13 is firmly fixed in position. Therefore, the fixing seat 12 and the sealing pad 13 can be easily installed in the limited space of the cover body 11, thereby achieving a simple and compact arrangement.

Preferably, the thickness of the sealing pad 13 is substantially equal to the depth of the indentation 122, such that the sealing pad 13 can be easily and firmly installed in the indentation 122, thereby stabling the positioning of the sealing pad 13. A diameter of the sealing pad 13 is smaller than the minimum diameter of the indentation 122. There are a plurality of positioning tips 124 at the bottom inner surface of the head part 121. The positioning tips 124 press against the sealing pad 13 so as to further increase the fixation of the sealing pad 13 and to prevent the sealing pad 13 from being moved or falling off from the fixing seat 12 and thus improving the stability and reliability during the usage of the glue bottle.

Preferably, the fixing seat 12 and the sealing pad 13 are made of silicone, which is difficult to be oxidized, has stable chemical characteristics and a long lifespan, is eco-friendly, and does not contain harmful material. Glue for grafting false eyelashes may often touches human skin, and it is much safer to adopt silicone material as the materials of the fixing seat 12 and the sealing pad 13 for preserving glue in the bottle body 21. There is at least one hole 125 located at an outer top surface of the head part 121. The hole 125 is connected to the indentation 122. More preferably, there are two holes 125 located opposite to each other with respect to an axis of the fixing seat 12. The holes 125 are in curved shapes and located close to the periphery of the head part 121. The holes 125 serve as air channel to the indentation 122 so as to prevent the indentation 122 from going vacuum during the installation of the sealing pad 13, thereby increasing the installation efficiency and facilitating the removal and maintenance of the sealing pad 13. The head part 121 has two rounded corners 126 respectively located at the outer top surface and a lower surface of the head part 121, achieving an easy installation and placement and increasing the installation efficiency.

Preferably, the extension portion 141 is in a cone shape tapering from the bottom to the top, having a visually-pleasing appearance and a well structural strength. The extension portion 141 has a first channel 147 therein. The first channel 147 is also in a cone shape tapering from the bottom to the top. An axis of the first channel 147 and an axis of the extension portion 141 are coaxial. More preferably, the mount portion 142 has a second channel 146. The second channel 146 is in a cylindrical shape, and an axis of the second channel 146 and an axis of the mount portion 142 are coaxial. The first channel 147 and the second channel 146 are coaxially connected to each other and together form the outlet channel. While using the glue bottle, the glue is squeezed out of the bottle body 21 through the second channel 146 and the first channel 147. The first channel 147 is in a cone shape tapering towards the outlet, which facilitates the amount and speed of the glue being squeezed out of each squeeze and thereby providing a precise amount of glue for each squeeze.

Preferably, a base portion 145 is coaxially disposed on the mount portion 142 and located below the mount portion 142. The base portion 145 has a groove 1451 located at an outer surface of the base portion 145 and an end of the base portion 145 connected to the mount portion 142. A first sealing ring 15 is disposed in the groove 1451. The first sealing ring 15 is located between and clamped by the bottle body 21 and the base portion 145. The first sealing ring 15 can prevent gas from entering into the bottle body 21 from the place between the mount portion 142 and the bottle body 21, thereby further facilitating the airtightness. Also, the sealing ring 15 can prevent the glue from leaking and entering into the place between the mount portion 142 and the bottle body 21, thereby avoiding wasting the glue.

Preferably, the cover body 11 has a recess 111 at a top end of the cover body 11 for facilitating the user to open the cover body 11 or the manufacturer to molding the cover body 11 and also can providing a visually-pleasing appearance. The cover body 11 further has a jagged structure 112 located at a lower portion of an outer surface of the cover body 11 to increase the friction while user holding it and therefore facilitates user to rotate the cover body 11 in the desired direction. The cover body 11 further has a plurality of reinforcement ribs 113 located at an upper portion of the outer surface of the cover body 11, and a top end of each of the reinforcement ribs 113 has a chamfer 1131. The chamfers 1131 are to provide a less pointy shape of the cover body 11. The reinforcement ribs 113 can increase the structural strength of the cover body 11.

When using the glue bottle, the first step is to remove the cap 40 from the housing 30, and then is to remove the head part 10 from the bottle body 21. Then, the bottle body 21 is placed upside down and squeezed, the protrusions 33 will be forced to deform the bottle body 21 so as to squeeze the glue out of the bottle body 21 through the outlet channel. Since the deformation of squeezing the housing 30 is consistent, the deformation of the bottle body 21 caused by the protrusions 33 will be fixed, such that the glue bottle is able to squeeze out a fixed volume of glue every time so as to achieve economical usage of the glue to reduce the cost and to ensure the quality of applying false eyelashes.

During the installation of the head part 10 to the bottle body 21, the sealing pad 13 is firstly fixed in the fixing seat 12, and then the fixing seat 12 is fixed in the cover body 11, such that the sealing pad 13, the fixing seat 12 and the cover body 11 are assembled as one body. On the other hand, the nozzle 14 and the bottle body 21 are fixed together so as to become one body. The first sealing ring 15 is located between and clamped by the bottle body 21 and the base portion 145, such that it achieves the airtightness of the bottle body 21 so as to prevent the glue in the bottle body 21 from leaking and entering into the place between the mount portion 142 and the bottle body 21 and avoid air from entering into the bottle 21 to oxidize the glue. The mount portion 142 is in contact with the inner surface of the bottle body 21, such that the mount portion 142 further seals the bottle body 21. After the cover body 11 and the bottle body 21 are tightly screwed with each other, two opposite surfaces of the flange 143 are respectively in contact with the contact surface 114 of the cover body 11 and the upper end surface of the bottle body 21, such that it prevents the gas from entering into the bottle body 21 from threads of the cover body 11 and the bottle body 21, thereby further facilitating the airtightness of the bottle body 21. During screwing the cover body 11 with the bottle body 21, the annular reinforcement portion 144 can guide the cover body 11. After the cover body 11 and the bottle body 21 are tightly screwed with each other, the nozzle 14 presses against the sealing pad 13, such that the sealing pad 13 seals the first channel 147 and the second channel 146, thereby maintaining the airtightness of the bottle body 21. The cover body 11 can provide friction to hand as the cover body is rotated by hand to be screwed with the bottle body 21, thereby facilitating the operation of the cover body 11. The glue bottle has a great airtightness, such that the glue may not be oxidized after the glue is stored in the glue bottle for a long time, thereby ensuring the quality of the glue and increasing the lifespan and safety of the glue, and thus allowing the glue remained in the glue bottle to be used at next eyelashes grafting process. Therefore, it saves the cost in purchasing new glue bottle with full glue in each eyelashes grafting process. Furthermore, the glue bottle can provide a constant amount of glue in each squeeze of the glue bottle, such that the quality of grafting false eyelashes can be maintained.

It will be apparent to those skilled in the art that various modifications and variations can be made to the present disclosure. It is intended that the specification and examples be considered as exemplary embodiments only, with a scope of the disclosure being indicated by the following claims and their equivalents.

What is claimed is:

1. A glue bottle capable of providing a constant amount of glue per one squeeze, comprising: a bottle body and a head part mating with each other, wherein a housing surrounds the bottle body, a top portion of the bottle body sticks out of the housing and mating with the head part, a bottom portion of the bottle body is disposed within the housing, the housing has a through hole located at a top end of the housing, a diameter of the through hole is smaller than a maximum diameter of the bottle body, the housing further has a guiding hole located at the top end of the housing and connected to the through hole, the bottle body has a guiding bar located at the top portion of the bottle body, the guiding bar mates with the guiding hole;

wherein the housing is made of elastic material, the housing further has at least one protrusion located at an inner surface of the housing and in contact with the bottle body, the housing further has at least one notch; when two opposite edges of the at least one notch are in contact with each other, the at least one protrusion is forced to squeeze the bottle body so as to deform the bottle body.

2. The glue bottle according to claim 1, wherein the at least one notch is a U-shaped tapered notch having an opening facing upward or downward, a length of the at least one notch is at least five-sixths to a length of the housing, and the at least one notch has two opposite surfaces that are at an angle ranging from 1.5 degrees to 2.5 degrees.

3. The glue bottle according to claim 1, wherein a cap is disposed on the top end of the housing, the cap has a plurality of reinforcement ribs arranged at an inner surface of the cap, the cap further has a step located at an end of the cap close to the housing, a sealing ring is disposed between the step and the housing, a portion of the sealing ring protruding the step is in contact with a bottom surface of the head part.

4. The glue bottle according to claim 1, wherein a central line of the at least one notch is perpendicular to a central line of the at least one protrusion, the at least one protrusion is located at a middle portion of the housing, the at least one notch extend vertically, and the at least one notch and the at least one protrusion have the same quantity.

5. The glue bottle according to claim 4, wherein the quantity of the at least one protrusion is two, the two protrusions are opposite to each other with respect to a central line of the housing, each of the two protrusions is a U-shaped structure having an opening facing downward, and an upper end and a lower end of each of the two protrusions have rounded corners.

6. The glue bottle according to claim 1, wherein the head part comprises a cover body, a nozzle, a sealing pad, and a fixing seat, the nozzle, the sealing pad, and the fixing seat are located in the cover body, the fixing seat is fixed at a top portion of the cover body, the sealing pad is fixed in the fixing seat, the nozzle is disposed on the bottle body; when the cover body and the bottle body are screwed with each other, a top portion of the nozzle presses against the sealing pad, a bottom portion of the nozzle is located below a contact surface of a middle portion of the cover body, the nozzle has an outlet channel connected to an accommodation space of the bottle body;

wherein the nozzle comprises an extension portion at the top portion of the nozzle and a mount portion at the bottom portion of the nozzle, an outer annular surface of the mount portion is in contact with an inner annular surface of the bottle body, the mount portion has a flange protruding outward, and the flange is located between and in contact with the contact surface of the cover body and an upper end surface of the bottle body.

7. The glue bottle according to claim 6, wherein an annular reinforcement portion extends downward from the flange, a gap between an inner annular surface of the annular reinforcement portion and the outer annular surface of the mount portion is larger than a thickness of the top portion of the bottle body, an outer diameter of the annular reinforcement portion is smaller than an inner diameter of a portion of the cover body located below the contact surface, the annular reinforcement portion has a uniform thickness, a lower portion of the annular reinforcement portion is inclined outward, the cover body has a recess located at a top end of the cover body, the cover body further has a jagged structure and a plurality of reinforcement ribs, the jagged structure is located at a lower portion of an outer surface of the cover body, the plurality of reinforcement ribs are located at an upper portion of the outer surface of the cover body, and a top end of each of the plurality of reinforcement ribs has a chamfer.

8. The glue bottle according to claim 6, wherein the extension portion is in a cone shape tapering from the bottom to the top of the extension portion, the extension portion has a first channel, the first channel is in a cone shape tapering from the bottom to the top of the extension portion, an axis of the first channel and an axis of the extension portion are coaxial, the mount portion has a second channel, the second channel is in a cylindrical shape, an axis of the second channel and an axis of the mount portion are coaxial, the first channel and the second channel are coaxially connected to each other and together form the outlet channel, a base portion is coaxially disposed on the mount portion and located below the mount portion, the base portion has a groove located at an outer surface of the base portion and an end of the base portion connected to the mount portion, a first sealing ring is disposed in the groove, the first sealing ring is located between and clamped by the bottle body and the base portion.

9. The glue bottle according to claim 6, wherein the fixing seat is T shape, the fixing seat comprises a head part, an indentation, and a positioning protrusion, the cover body has a positioning recess inside, the head part is fixed in the positioning recess, the sealing pad is disposed in the indentation, the positioning protrusion is disposed in a lower portion of the indentation and extends inwards, a lower surface of the sealing pad is in contact with an upper surface of the positioning protrusion, the fixing seat and the sealing pad are made of elastic material.

10. The glue bottle according to claim 9, wherein a thickness of the sealing pad is substantially equal to a depth of the indentation, a diameter of the sealing pad is smaller than a minimum diameter of the indentation, there are a plurality of positioning tips at a bottom inner surface of the head part, the plurality of positioning tips press against the sealing pad, the fixing seat and the sealing pad are made of silicone, there is at least one hole located at an outer top surface of the head part, the at least one hole is connected to the indentation, the quantity of the at least one hole is two, the two holes are opposite to each other with respect to an axis of the fixing seat, the two holes are curved shapes and located close to a periphery of the head part, the head part has two rounded corners respectively located at the outer top surface and a lower surface of the head part.

* * * * *